US009508355B2

(12) United States Patent
Lee et al.

(10) Patent No.: US 9,508,355 B2
(45) Date of Patent: Nov. 29, 2016

(54) METHOD AND APPARATUS FOR IMPROVING ENCODING AND DECODING EFFICIENCY OF AN AUDIO SIGNAL

(71) Applicant: SAMSUNG ELECTRONICS CO., LTD., Suwon-si (KR)

(72) Inventors: Nam-suk Lee, Suwon-si (KR); Hyun-wook Kim, Suwon-si (KR); Han-gil Moon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 277 days.

(21) Appl. No.: 14/022,806

(22) Filed: Sep. 10, 2013

(65) Prior Publication Data

US 2014/0163999 A1 Jun. 12, 2014

(30) Foreign Application Priority Data

Dec. 11, 2012 (KR) ..... 10-2012-0143833

(51) Int. Cl.
*G10L 19/022* (2013.01)
*G10L 25/45* (2013.01)
*G10L 19/02* (2013.01)

(52) U.S. Cl.
CPC ..... *G10L 19/022* (2013.01); *G10L 25/45* (2013.01); *G10L 19/0212* (2013.01)

(58) Field of Classification Search
CPC combination set(s) only.
See application file for complete search history.

(56) References Cited

U.S. PATENT DOCUMENTS

2003/0115052 A1* 6/2003 Chen ..... G10L 19/02 704/230
2007/0016405 A1 1/2007 Mehrotra et al.
2008/0059202 A1 3/2008 You
2008/0065373 A1 3/2008 Oshikiri
2008/0215317 A1* 9/2008 Fejzo ..... G10L 19/0017 704/217
2011/0087494 A1* 4/2011 Kim ..... G10L 19/0212 704/500
2012/0022881 A1 1/2012 Geiger et al.
2012/0136670 A1* 5/2012 Ishikawa ..... G10L 21/038 704/500

FOREIGN PATENT DOCUMENTS

WO 2010/086373 A2 8/2010

OTHER PUBLICATIONS

ISR (PCT/ISA/210) issued Mar. 27, 2014, in related International Application No. PCT/KR2013/011495.
Communication dated May 3, 2016, issued by European Patent Office in counterpart European Application No. 13863103.1.
Henrique S. Malvar., "Lapped Transforms for Efficient Transform/Subband Coding", IEEE Transactions Speech and Signal Processing, Jun. 1, 1990, 10 pages total, vol. 38, No. 6, New York, USA, XP000138423.

* cited by examiner

*Primary Examiner* — Barbara Reinier
(74) *Attorney, Agent, or Firm* — Sughrue Mion, PLLC

(57) ABSTRACT

Exemplary embodiments may provide a method of encoding an audio signal. The method includes: segmenting the audio signal into a plurality of frames, wherein each of the frames includes M samples and M is a natural number greater than one; applying a first window, a second window, and at least one third window to the frames, wherein a length of the second window is longer than a length of the first window, and a length of the third window is longer than the length of the first window and shorter than the length of the second window; time-frequency transforming the frames to which the first window, the second window, and the at least one third window have been applied; and generating a bitstream including the time-frequency transformed frames.

30 Claims, 7 Drawing Sheets

METHOD AND APPARATUS FOR IMPROVING ENCODING AND DECODING EFFICIENCY OF AN AUDIO SIGNAL

CROSS-REFERENCE TO RELATED PATENT APPLICATION

This application claims priority from Korean Patent Application No. 10-2012-0143833, filed on Dec. 11, 2012, in the Korean Intellectual Property Office, the disclosure of which is incorporated herein in its entirety by reference.

BACKGROUND

1. Field

Exemplary embodiments relate to a method of encoding and decoding an audio signal, and an apparatus for encoding and decoding an audio signal. More particularly, exemplary embodiments relate to a method and apparatus for time-frequency transforming frames of an audio signal by applying a first window, a second window, and a third window to the frames.

2. Description of the Related Art

Related art apparatuses for encoding audio, having high sound quality, use a time-frequency transform method. The time-frequency transform method of the related art is a method of encoding coefficients, obtained by transforming an input audio signal to a frequency space, using a transform method, such as a modified discrete cosine transform (MDCT).

The time-frequency transform of the related art uses a signal in a frequency domain, which is easier to encode than a signal in a time domain. Since a window shape applied to an audio signal is closely related to a frequency resolution, the window shape should be properly selected.

SUMMARY

Exemplary embodiments may provide a method of encoding and decoding an audio signal, and an apparatus for encoding and decoding an audio signal to reduce a delay, occurring due to the encoding and the decoding of the audio signal.

Exemplary embodiments may provide a method of encoding and decoding an audio signal, and an apparatus for encoding and decoding an audio signal, to improve an encoding and decoding efficiency of the audio signal.

According to an aspect of the exemplary embodiments, there is provided a method of encoding an audio signal, the method including: segmenting the audio signal into a plurality of frames, wherein each of the frames include M samples and M is a natural number greater than one; applying a first window, a second window, and at least one third window to the frames, wherein a length of the second window is longer than a length of the first window, and a length of the at least one third window is longer than the length of the first window and shorter than the length of the second window; time-frequency transforming the frames to which the first window, the second window, and the at least one third window have been applied; and generating a bitstream including the time-frequency transformed frames.

The applying the first window, the second window, and the at least one third window to the frames may include applying the first window, the second window, or the at least one third window to one transform unit.

The first window, the second window, and the at least one third window may have a same overlapping duration length where the first window, the second window, and the at least one third window overlap each other, except for durations in which a coefficient is zero.

The applying the first window, the second window, and the at least one third window to the frames may include: applying the first window to a transient duration which includes a transient signal of the audio signal; and applying the at least one third window, which overlaps the first window, which has been applied to the transient duration, to a transform unit including the transient duration.

A frame size of the at least one third window may be determined according to a frame size of the first window applied to the transient duration.

The applying of the first window, the second window, and the at least one third window to the frames may include applying the first window and one the at least one third window, or two of the at least one third window, overlapping each other in a variation duration, in which signal characteristics vary in the audio signal, to a transform unit which includes the variation duration.

Each of the second window and the at least one third window may include a first zero duration and a second zero duration, in which a coefficient is zero, and a first unity duration and a second unity duration, in which a coefficient is one, and a length of the first zero duration, the second zero duration, the first unity duration, and the second unity duration may be determined to satisfy a perfect reconstruction condition.

The length of the first zero duration, the second zero duration, the first unity duration, and the second unity duration may be determined as $(F-L)\div 2$, where F denotes a frame size of a corresponding window, and L denotes an overlapping duration length between windows.

M may be $2^k$, and a length of the first window, the second window, and the at least one third window may be $2^k$ samples.

The bitstream may include information regarding applied windows to the frames of the audio signal.

According to another aspect of the exemplary embodiments, there is provided a method of decoding an audio signal, the method including: extracting a plurality of frames of a time-frequency transformed audio signal and information regarding applied windows to the frames, from a bitstream; time-frequency detransforming the extracted frames; and generating an audio signal by synthesizing the time-frequency detransformed frames based on the information regarding the applied windows, wherein the applied windows to the frames include a first window, a second window, and at least one third window, wherein a length of the second window is longer than the length of the first window, and a length of the at least one third window is longer than the length of the first window and shorter than the length of the second window.

The generating of the audio signal may include applying the first window, the second window, or the at least one third window to one transform unit, included in the time-frequency detransformed frames.

The first window, the second window, and the at least one third window may have a same overlapping duration length where the first window, the second window, and the at least one third window overlap each other, except for durations in which a coefficient is zero.

Each of the second window and the at least one third window may include a first zero duration and a second zero duration, in which a coefficient is zero, and a first unity duration and a second unity duration of which a coefficient is one, and a length of the first zero duration, the second zero duration, the first unity duration, and the second unity duration may be determined to satisfy a perfect reconstruction condition.

The length of the first zero duration, the second zero duration, the first unity duration, and the second unity duration may be determined as (F−L)÷2, where F denotes a frame size of a corresponding window, and L denotes an overlapping duration length between windows.

M may be $2^k$, and a length of the first window, the second window, and the at least one third window may be $2^k$ samples.

According to another aspect of the exemplary embodiments, there is provided a non-transitory computer-readable storage medium having stored therein program instructions, which when executed by a computer, performs the method of encoding an audio signal.

According to another aspect of the exemplary embodiments, there is provided a non-transitory computer-readable storage medium having stored therein program instructions, which when executed by a computer, performs the method of decoding an audio signal.

According to another aspect of the exemplary embodiments, there is provided an apparatus for encoding an audio signal, the apparatus including: a segmentation unit configured to segment the audio signal into a plurality of frames, wherein each of the frames includes M samples and M is a natural number greater than one; a window applying unit configured to apply a first window, a second window, and at least one third window to the frames, wherein a length of the second window is longer than a length of the first window, and a length of the at least one third window is longer than the length of the first window and shorter than the length of the second window; a transformer configured to time-frequency transform the frames to which the first window, the second window, and the at least one third window have been applied; and a multiplexer configured to generate a bitstream, including the time-frequency transformed frames.

The window applying unit may be configured to apply the first window, the second window, or the at least one third window to one transform unit.

The window applying unit is configured to apply the first window, the second window, and the at least one third window to the frames, such that overlapping durations, in which the first window, the second window, and the at least one third window overlap each other, have a same length, except for durations in which a coefficient is zero.

The apparatus may further include an analyzer for analyzing characteristics of the audio signal, wherein the window applying unit is configured to apply the first window to a transient duration analyzed by the analyzer, and configured to apply at least one third window, which overlaps the first window, which has been applied to the transient duration, to a transform unit including the transient duration.

The window applying unit may be configured to set a frame size of the at least one third window according to a frame size of the first window applied to the transient duration.

The window applying unit may be configured to apply the first window and the at least one third window, or two of the at least one third window, overlapping each other in a variation duration, in which characteristics of the audio signal analyzed by an analyzer vary, to a transform unit which includes the variation duration.

Each of the second window and the at least one third window may include a first zero duration and a second zero duration, in which a coefficient is zero, and a first unity duration and a second unity duration in which a coefficient is one, and the window applying unit may be configured to determine a length of the first zero duration, the second zero duration, the first unity duration, and the second unity duration to satisfy a perfect reconstruction condition.

The window applying unit may be configured to determine the length of the first zero duration, the second zero duration, the first unity duration, and the second unity duration as (F−L)÷2, where F denotes a frame size of a corresponding window, and L denotes an overlapping duration length between windows.

M may be $2^k$, and a length of the first window, the second window, and the at least one third window may be $2^k$ samples.

The bitstream may include information regarding applied windows to the frames of the audio signal.

According to another aspect of the exemplary embodiments, there is provided an apparatus for decoding an audio signal, the apparatus including: a demultiplexer configured to extract a plurality of frames of a time-frequency transformed audio signal and information regarding applied windows to the frames, from a bitstream; a detransformer configured to time-frequency detransform the extracted frames; and a synthesizer configured to generate an audio signal by synthesizing the time-frequency detransformed frames based on the information regarding the applied windows, wherein the applied windows to the frames include a first window, a second window, and at least one third window, wherein a length of the second window is longer than a length of the first window, and a length of the at least one third window is longer than the length of the first window and shorter than the length of the second window.

The synthesizer may be configured to apply the first window, the second window, or the at least one third window to one transform unit, included in the time-frequency detransformed frames.

The first window, the second window, and the at least one third window may have a same overlapping duration length where the first window, the second window, and the at least one third window overlap each other, except for durations in which a coefficient is zero.

Each of the second window and the at least one third window may include a first zero duration and a second zero duration, in which a coefficient is zero, and a first unity duration and a second unity duration, in which a coefficient is one, and a length of the first zero duration, the second zero duration, the first unity duration, and the second unity duration may be determined to satisfy a perfect reconstruction condition.

The length of the first zero duration, the second zero duration, the first unity duration, and the second unity duration may be determined as (F−L)÷2, where F denotes a frame size of a corresponding window, and L denotes an overlapping duration length between windows.

M may be $2^k$, and a length of the first window, the second window, and the at least one third window may be $2^k$ samples.

According to another aspect of the exemplary embodiments, there is provided a method of applying a plurality of windows to an audio signal, the method including: applying a first window to a plurality of frames in an audio signal; applying a second window, which is longer than a length of the first window, to the frames; and applying at least one third window, which is longer than the length of the first window and shorter than a length of the second window, to the frames, wherein the first window, the second window, and the at least one third window have a same overlapping duration length.

BRIEF DESCRIPTION OF THE DRAWINGS

The above and other features and advantages of the exemplary embodiments will become more apparent by describing in detail exemplary embodiments thereof with reference to the attached drawings in which.

DETAILED DESCRIPTION

Figure 1:
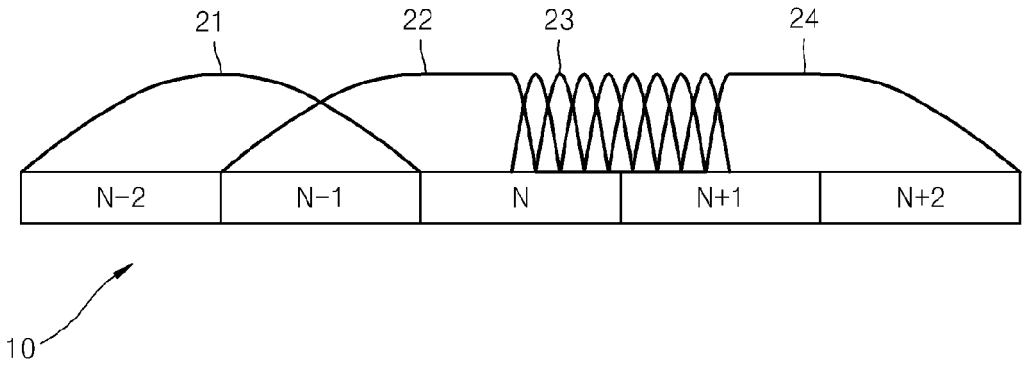
FIG. 1 illustrates a method of applying windows to an audio signal to perform a modified discrete cosine transform (MDCT) on the audio signal in a related art advanced audio coding (AAC) codec.

Advantages and features of the exemplary embodiments, and a method for achieving them will be clear with reference to the accompanying drawings, in which exemplary embodiments are shown. The exemplary embodiments may, however, be embodied in many different forms and should not be construed as being limited to the embodiments set forth herein. These embodiments are provided so that this disclosure will be thorough and complete, and will fully convey the concept of the exemplary embodiments to one of ordinary skill in the art. Like reference numerals denote like elements throughout the specification.

The term ' . . . unit' used in the embodiments indicates a component including software or hardware, such as a Field Programmable Gate Array (FPGA) or an Application-Specific Integrated Circuit (ASIC), and the ' . . . unit' performs certain roles. However, the ' . . . unit' is not limited to software or hardware. The ' . . . unit' may be configured to be included in an addressable storage medium or to reproduce one or more processors. Therefore, for example, the ' . . . unit' includes components, such as software components, object-oriented software components, class components, and task components, processes, functions, attributes, procedures, subroutines, segments of program code, drivers, firmware, microcode, circuits, data, a database, data structures, tables, arrays, and variables. A function provided inside components and ' . . . units' may be combined into a smaller number of components and ' . . . units', or further divided into additional components and ' . . . units'.

In the specification, the expression "a length of a window or a predetermined duration is a (a is a natural number) samples" indicates "the window or the predetermined duration includes a samples".

In addition, in the specification, "a frame size of a predetermined window" indicates the number of coefficients in a frequency domain, as acquired when frames in a time domain to which the predetermined window is applied are time-frequency transformed.

FIG. 1 illustrates a method of applying windows to an audio signal 10 to perform a modified discrete cosine transform (MDCT) on the audio signal 10 in a related art advanced audio coding (AAC) codec.

The related art AAC codec is defined as a window applied to frames N−2, N−1, N, N+1, and N+2 of the audio signal 10. The audio signal 10 includes i) a long window 21, ii) a short window 23, iii) a long start window 22, and iv) a long short window 24.

A length of each of the frames N−2, N−1, N, N+1, and N+2 of the audio signal 10 shown in FIG. 1 is 1024 samples. A length of each of the long window 21, the long start window 22, and the long short window 24 is 2048 samples. A length of the short window 23 is 256 samples.

When n samples, to which a window is applied, are time-frequency transformed, n/2 coefficients are acquired. Thus, a frame size of each of the long window 21, the long start window 22, and the long short window 24 is 1024, and a frame size of the short window 23 is 128.

The long window 21, the long start window 22, the long short window 24, and the short window 23 overlap one other by 50%.

The audio signal 10 may be distinguished in transform units, wherein the "transform unit" indicates a duration in which a same number of coefficients can be acquired, when the time-frequency transform is performed, by applying a window.

Since the longest window of windows defined by the AAC codec is the long window 21, the long start window 22, or the long short window 24, one long window 21, one long start window 22, or one long short window 24 may be applied to one transform unit. In other words, a length of a transform unit for the long window 21, the long start window 22, or the long short window 24 is 2048 samples.

When it is desired to apply the short window 23 to one transform unit, a total of 8 short windows 23 (8×128=1024) are applied to the transform unit so that the number of coefficients is 1024. Since the 8 short windows 23 overlap one other by 50%, a length of the transform unit, to which the 8 short windows 23 are applied, is less than 2048 samples. In other words, a length of a transform unit may vary, according to a type of a window applied to the transform unit.

The related art AAC codec applies the short window 23 to a signal quickly varying in the time domain, i.e., a transient signal, to increase a frequency resolution, and applies the long window 21 to a signal slowly varying in the time domain, to prevent the waste of a frequency band. The long start window 22 is applied to frames to overlap a first short window 23 when a short window set starts, and the long short window 24 is applied to frames to overlap a last short window 23 when the short window set ends.

According to the related art AAC codec, since a delay due to the 50% overlapping between every two windows and a delay due to window switching to the long start window 22 or the long short window 24 occur, there is a problem that coding efficiency is deteriorated.

In addition, since the related art AAC codec applies 8 short windows 23 to the entire transform unit even, when a transient signal exists in only a partial duration of the transform unit, there is also a problem that coding efficiency is deteriorated.

Figure 2:
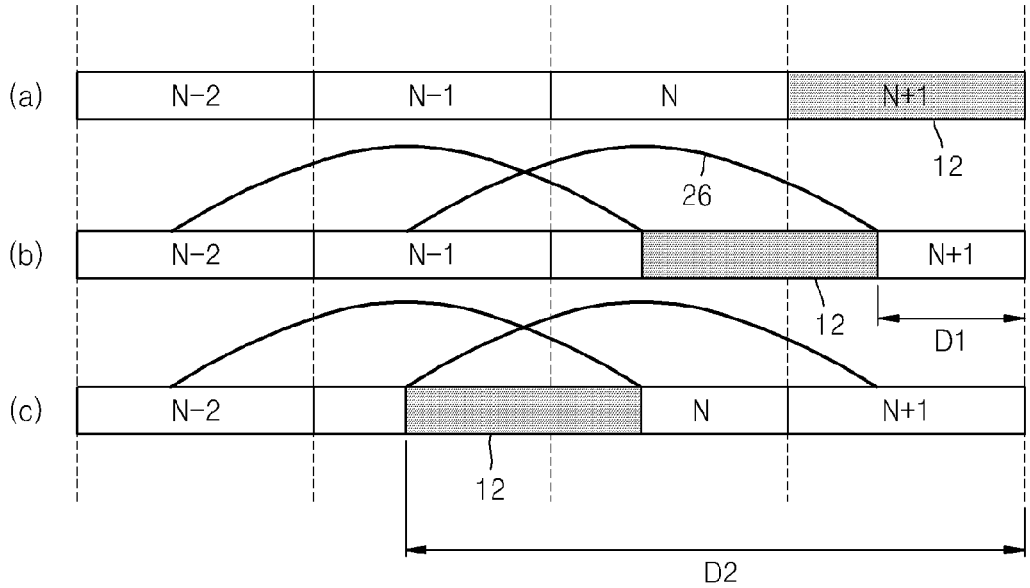
FIG. 2 is diagrams for describing a delay occurring due to encoding and decoding when the related art AAC codec is used.

FIGS. 2A to 2C are diagrams for describing a delay occurring due to encoding and decoding when the related art AAC codec is used.

FIG. 2A illustrates an audio signal input to an encoder, FIG. 2B illustrates a time-frequency transform performed by the encoder, and FIG. 2C illustrates a time-frequency detransform performed by a decoder.

In the related art AAC codec, a window 26 to be applied to a current frame 12 is determined as a long window or a long start window, according to whether a window to be applied to a next frame is a short window. In other words, referring to FIG. 2B, the encoder determines the window 26 to be applied to the current frame 12 to time-frequency transform the current frame 12, and the determination of the window 26 is performed after a predetermined number of samples included in the next frame are analyzed by the encoder. The predetermined samples are look-ahead samples for window switching. Thus, encoding is delayed by the look-ahead samples.

Referring to FIGS. 1 and 2A to 2C, since a length of a short window set to be applied to the next frame of the current frame 12 is 576 samples (128×4+128÷2), at least 576 look-ahead samples are required to determine the window 26 to be applied to the current frame 12. An encoding delay D1 occurs due to the look-ahead samples.

The decoder should wait for the next frame overlapping the current frame 12 to time-frequency detransform the current frame 12. Since every two windows overlap one other by 50% in the MDCT, 1024 samples that are 50% of 2048 samples overlap the current frame 12. Thus, a delay occurs due to an overlapping duration in the decoder.

In addition, when the current frame 12 is a first frame of the audio signal, the decoder requires a delay of 1024 samples to process the current frame 12.

In conclusion, a delay D2 due to encoding and decoding in the related art AAC codec includes the delay D1 due to the look-ahead samples, a delay due to the overlapping duration, and the delay due to the current frame 12. Therefore, when a sampling rate is 48 KHz, a total delay due to the related art AAC codec is 54.7 ms.

Figure 3:
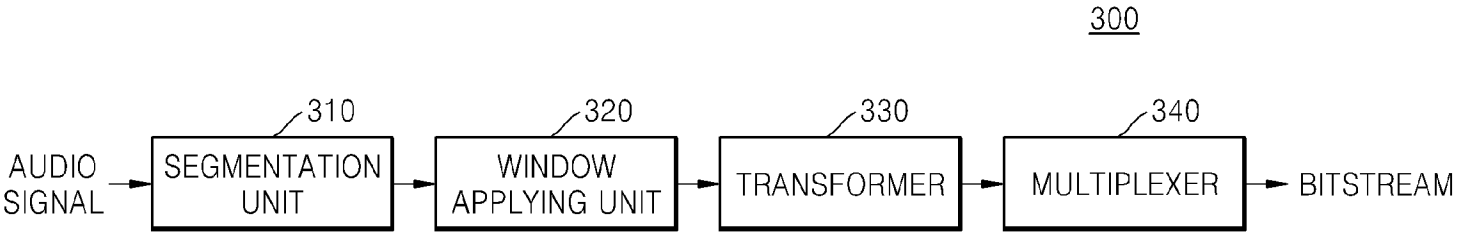
FIG. 3 is a block diagram of an apparatus for encoding an audio signal, according to an embodiment.

FIG. 3 is a block diagram of an apparatus 300 for encoding an audio signal, according to an embodiment.

Referring to FIG. 3, the apparatus 300 may include a segmentation unit 310, a window applying unit 320, a transformer 330, and a multiplexer 340. The segmentation unit 310, the window applying unit 320, the transformer 330, and the multiplexer 340 may be formed by a microprocessor.

The segmentation unit 310 may receive an audio signal and segment the received audio signal into frames each including M (M is a natural number greater than 1) samples. The segmentation unit 310 may receive the audio signal from a memory unit (not shown) included in the apparatus 300, or an external device.

The window applying unit 320 applies a first window, a second window, and at least one third window to the frames of the audio signal. The second window may be longer than a length of the first window, and the third window may have a length between the length of the first window and the length of the second window. The window applying unit 320 may apply at least one first window, at least one second window, or at least one third window to one transform unit. In the specification, in comparison with the related art AAC codec, it is assumed that the length of the first window is 256 samples, and the length of the second window is 2048 samples. However, the lengths of the first window and the second window may be variously set in a range that is obvious to one of ordinary skill in the art.

Figure 4:
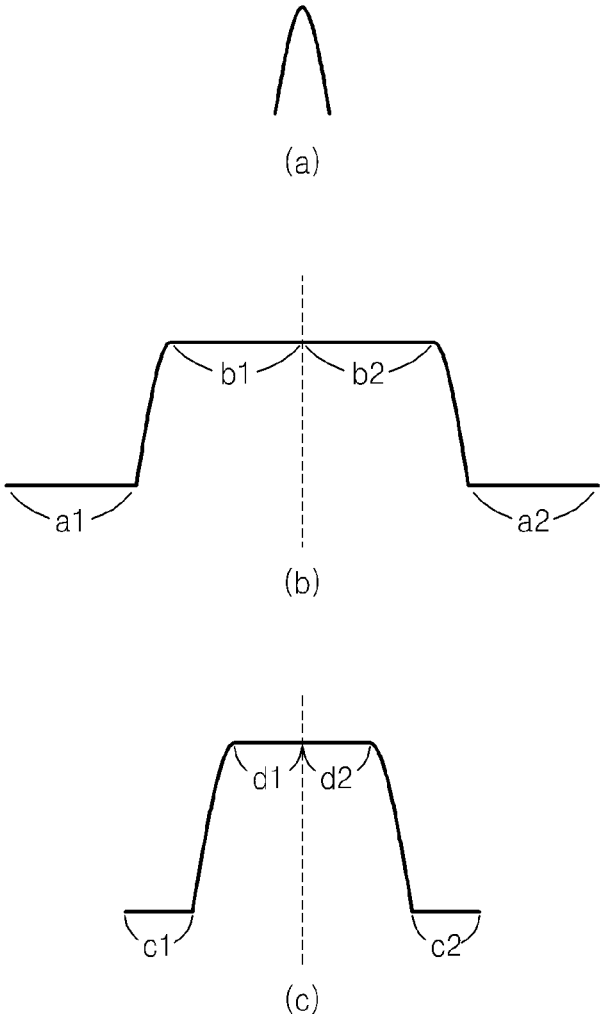
FIG. 4 illustrates a first window, a second window, and a third window applied to frames of an audio signal in the apparatus for encoding an audio signal, according to an embodiment.

The first window, the second window, and the third window will be described below in detail, with reference to FIG. 4.

The transformer 330 time-frequency transforms the frames to which the first window, the second window, and the third window are applied. The time-frequency transform, according to the exemplary embodiments, may include any one of discrete cosine transform (DCT), modified discrete cosine transform (MDCT), and fast Fourier transform (FFT).

The multiplexer 340 generates and outputs a bitstream, including the time-frequency transformed frames.

Although not shown in FIG. 3, the apparatus 300 may further include a quantizer for quantizing coefficients in the frequency domain, which are generated by the transformer 330, and a bit allocator for allocating bits to the quantized coefficients.

FIGS. 4A to 4C illustrate the first window, the second window, and the third window, applied to frames of an audio signal in the apparatus 300 for encoding an audio signal, according to an embodiment.

FIGS. 4A, 4B, and 4C illustrate the first window, the second window, and the third window, respectively.

As described above, the length of the first window may be 256 samples, and the length of the second window may be 2048 samples. The length of the third window is longer than the length of the first window, and shorter than the length of the second window. The third window may have various lengths, according to characteristics of audio signals.

Referring to FIG. 4B, the second window, according to the exemplary embodiments, may include first and second zero durations a1 and a2 of which a coefficient is 0 (zero), and first and second unity durations b1 and b2 of which a coefficient is 1. In addition, referring to FIG. 4C, like the second window, the third window may also include first and second zero durations c1 and c2 and first and second unity durations d1 and d2. On the contrary, the first window shown in FIG. 4A may not include zero durations and unity durations.

Figure 5:
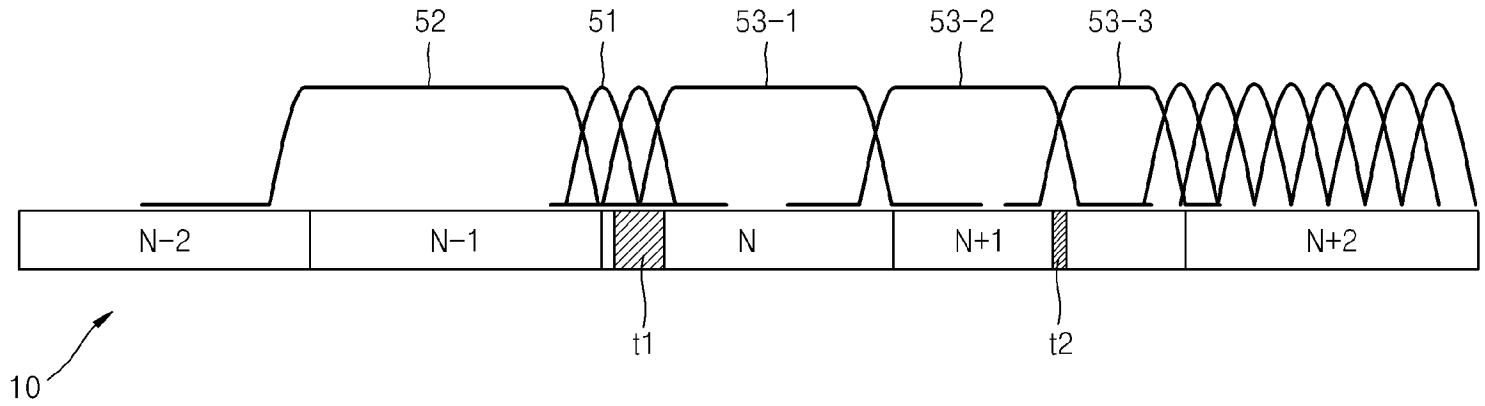
FIG. 5 illustrates frames of an audio signal to which a first window, a second window, and a third window are applied in the apparatus for encoding an audio signal, according to an embodiment.

FIG. 5 illustrates frames of an audio signal 10 to which a first window 51, a second window 52, and a third window 53 are applied in the apparatus 300 for encoding the audio signal 10, according to an embodiment.

First, the window applying unit 320 may apply the first window 51, the second window 52, and the third window 53 to the frames, except for durations of which a coefficient is 0 (zero) so that overlapping duration lengths between every two windows are all the same.

In the related art AAC codec, an overlapping duration length between a long window and another long window differs from an overlapping duration length between a short window and another short window. Accordingly, a long start window and a long short window are required to connect a long window and a short window. However, since overlapping duration lengths between every two of the first windows 51, the second windows 52, and the third windows 53 are all the same according to the exemplary embodiments, neither long start windows nor long short windows are required. In addition, each of the overlapping duration lengths between every two of the first windows 51, the second windows 52, and the third windows 53 may be set to ½ of the length of the first window 51. In other words, each overlapping duration length may be 128 samples. According to the exemplary embodiments, since overlapping duration lengths between every two windows are much less than those in the related art AAC codec, a delay due to window overlapping is reduced.

As described above, while coding efficiency is deteriorated by applying 8 short windows to the entire transform unit in the related art AAC codec when a transient signal duration exists in part of a duration of one transform unit, referring to FIG. 5, the window applying unit 320 may apply at least one first window 51 only to a transient signal duration t1, from which a transient signal is detected. In addition, in the duration remaining by excluding the transient signal duration t1 from the transform unit, the window applying unit 320 may apply at least one third window 53-1, of which a length has been properly adjusted to the transform unit, so that the at least one third window 53-1 overlaps the at least one first window 51.

Although not shown in FIG. 3, the apparatus 300 may further include an analyzer for analyzing characteristics of an audio signal. The analyzer may determine whether a transient duration exists in a current frame, by calculating a similarity or mean energy difference between frames of the audio signal. The analyzer does not have to be separately included, when the apparatus 300 has a function of determining a transient duration. For example, when the apparatus 300 has a wave coder or a parametric coder, such as AAC, MP3, etc., functioning to determine a transient duration, the corresponding function may be used.

A method of properly selecting a length of a third window will now be described.

When a first window of the windows according to the related art AAC codec is applied to one transform unit, 8 first windows are required.

However, since the window applying unit 320 applies the first window 51 only to the duration t1 in which a transient signal exists, the number of first windows 51 may be 6 or less.

When 6 first windows 51 are applied, since a sum of frame sizes of the 6 first windows 51 is 768 (128×6), a frame size of the third window 53-1 is 256, and a length of the third window 53-1 is 512 samples. Since the third window 53-1 is applied next to two first windows 51 in FIG. 5, a length of the third window 53-1 is 1536 samples.

In addition, the window applying unit 320 may apply one first window 51 and one third window 53, or two third windows 53-2 and 53-3, overlapping each other in a variation duration t2, to a transform unit including the variation duration t2, in which characteristics of the audio signal vary. The characteristics of the audio signal may include various characteristics, such as a frequency, tone, intensity, etc., by which the audio signal can be evaluated. A variation duration may include a transient signal duration. If a length of a variation duration, in which characteristics of an audio signal variance is very short, only two windows may overlap each other, to improve coding efficiency. A length of each of the two third windows 53-2 and 53-3 shown in FIG. 5 may be set in the method described above. In other words, when a length of any one of the two third windows 53-2 and 53-3 is determined, a length of the other of the two third windows 53-2 and 53-3 may be determined, such that a sum of frame sizes of the two third windows 53-2 and 53-3 is the same as a frame size of the second window 52.

Referring back to FIG. 3, the window applying unit 320 may determine a form of the third window to satisfy a perfect construction condition of the time-frequency transform.

Under the Princen-Bradley condition, a window applied to a frame should satisfy Equation 1 below:

$$w^2(n)=w^2(n+M)=1 \quad (1)$$

In Equation 1, w denotes a window function, n denotes a sample index, and M denotes a frame length.

In addition, to satisfy Equation 1 above, a length of a first zero duration, a second zero duration, a first unity duration, and a second unity duration of the window should satisfy Equation 2 below:

$$(F-L)/2 \quad (2)$$

In Equation 2, F denotes a frame size of a window, and L denotes an overlapping duration length.

Since the overlapping duration length is 128 samples, a length of a first zero duration, a second zero duration, a first unity duration, and a second unity duration of a second window is 448 samples ((1024−128)/2).

Table 1 below shows lengths R of a first zero duration, a second zero duration, a first unity duration, and a second unity duration according to frame sizes of windows:

TABLE 1

| F | R |
|---|---|
| 1024 (128 × 8) | 448 |
| 896 (128 × 7) | 384 |
| 768 (128 × 6) | 320 |
| 640 (128 × 5) | 256 |
| 512 (128 × 4) | 192 |
| 384 (128 × 3) | 120 |
| 256 (128 × 2) | 64 |
| 128 (128 × 1) | 0 |

In Table 1, a window of which a frame size is 896 indicates a third window to be applied to a transform unit by overlapping a single first window, when the single first window is applied to the transform unit.

According to the exemplary embodiments, M, a length of a first window, a length of a second window, and a length of a third window may be set to $2^k$. Accordingly, a computation amount required for encoding and decoding may be reduced.

The window applying unit 320 may generate information regarding windows applied to the frames of the audio signal, and transmits the generated information to the multiplexer 340. The multiplexer 340 may generate and output a bitstream, including the time-frequency transformed frames and the information regarding the windows.

Figure 6:
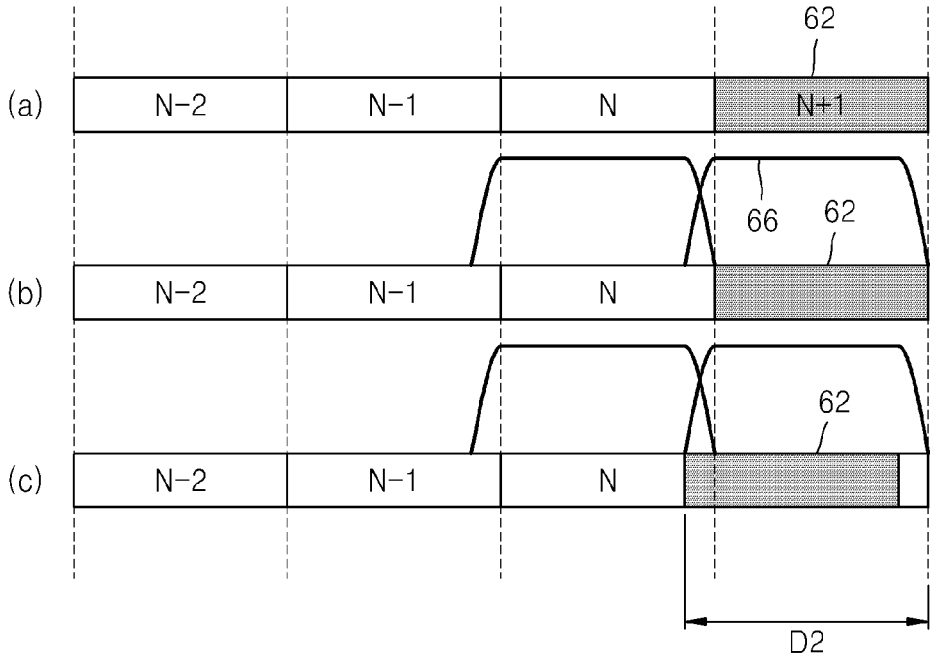
FIG. 6 is diagrams for describing a delay occurring due to encoding and decoding in the apparatus for encoding an audio signal, according to an embodiment.

FIGS. 6A to 6C are diagrams for describing a delay occurring due to encoding and decoding in the apparatus 300 for encoding an audio signal, according to an embodiment.

FIG. 6A illustrates an audio signal input to an encoder, FIG. 6B illustrates a time-frequency transform performed by the encoder, and FIG. 6C illustrates a time-frequency detransform performed by a decoder.

As described above, in the related art AAC codec, an encoder requires look-ahead samples to determine the window 26 to be applied to the current frame 12. However, according to the exemplary embodiments, since the first windows, the second windows, and the third windows have the same overlapping duration lengths, no look-ahead samples are required to determine a window 66 to be applied to a current frame 62. Thus, in the encoding shown in FIG. 6A, a delay due to look-ahead samples does not occur.

The decoder, according to the exemplary embodiments, also should wait for a next frame overlapping the current frame 62. Since each of overlapping duration lengths between every two of the first windows, the second windows, and the third windows is 128 samples, an overlapping delay of 128 samples occurs in the decoder according to the exemplary embodiments, which is significantly less than a delay of 1024 samples, occurring in the related art AAC codec.

In addition, when the current frame 62 is a first frame of the audio signal, the decoder according to the exemplary embodiments requires a delay of 1024 samples, to process the current frame 62, as in the related art AAC codec.

In conclusion, a delay D2 due to the encoding and the decoding, according to the exemplary embodiments, includes a delay due to an overlapping duration and a delay due to the current frame 62. When a sampling rate is 48 KHz, a total delay is 24 ms.

Figure 7:
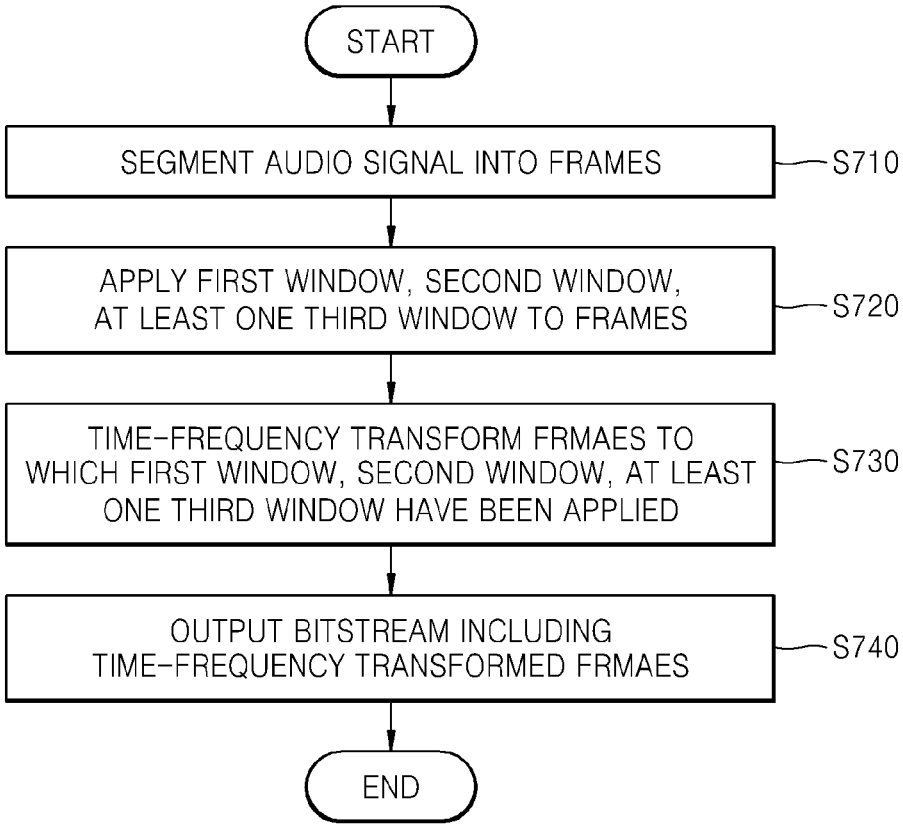
FIG. 7 is a flowchart illustrating a method of encoding an audio signal, according to another embodiment.

FIG. 7 is a flowchart illustrating a method of encoding an audio signal, according to another embodiment. Referring to FIG. 7, the method includes operations processed by the apparatus 300 shown in FIG. 3. Thus, although omitted hereinafter, the above description related to the apparatus 300 shown in FIG. 3 also applies to the method of FIG. 7.

In operation S710, the apparatus 300 segments an input audio signal into frames. Each of the frames may include M (M is a natural number greater than 1) samples.

In operation S720, the apparatus 300 applies a first window, a second window, and at least one third window to the frames. A length of the first window is shortest, a length of the second window is longest, and a length of the third window is between the length of the first window and the length of the second window.

In operation S730, the apparatus 300 time-frequency transforms the frames to which the first window, the second window, and the at least one third window have been applied. The time-frequency transform may include any one of DCT, MDCT, and FFT.

In operation S740, the apparatus 300 outputs a bitstream, including the time-frequency transformed frames. The bitstream may further include information regarding the windows applied to the frames, wherein the information regarding the windows may include type or length information of the windows applied to the frames.

Figure 8:
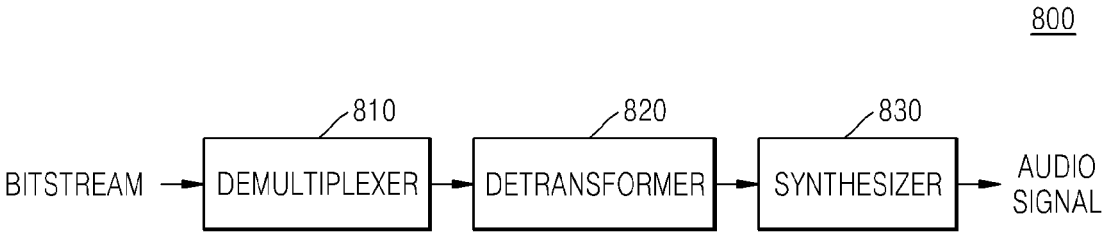
FIG. 8 is a block diagram of an apparatus for decoding an audio signal, according to another embodiment.

FIG. 8 is a block diagram of an apparatus 800 for decoding an audio signal, according to another embodiment.

Referring to FIG. 8, the apparatus 800 may include a demultiplexer 810, a detransformer 820, and a synthesizer 830. The demultiplexer 810, the detransformer 820, and the synthesizer 830 may be formed by a microprocessor.

The demultiplexer 810 may extract frames of a time-frequency transformed audio signal and information regarding windows applied to the frames, from a bitstream. The bitstream may be received from an external encoding apparatus 300.

The detransformer 820 time-frequency detransforms the frames of the time-frequency transformed audio signal. The detransformer 820 may time-frequency detransform the frames in a method corresponding to the time-frequency transform method performed by the apparatus 300.

The synthesizer 830 may generate an audio signal by synthesizing the time-frequency detransformed frames based on the information regarding the windows, which has been extracted from the bitstream. In detail, the synthesizer 830 may generate the audio signal by applying the same windows as those used in the apparatus 300 to the time-frequency detransformed frames, based on the information regarding the windows, which has been extracted from the bitstream, and synthesizing the frames to which the windows have been applied. In addition, the synthesizer 830 may apply at least one first window, at least one second window, and at least one third window to one transform unit.

The information regarding the windows, which is included in the bitstream, may include information regarding the first window, the second window, and the third window, wherein a length of the first window may be shortest, a length of the second window may be longest, and a length of the third window may be between the length of the first window and the length of the second window.

Since the first window, the second window, and the third window have been described above in relation to the apparatus 300, a detailed description thereof is omitted.

Although not shown in FIG. 8, the apparatus 800 may further include a dequantizer and an inverse bit allocator, to correspond to the apparatus 300.

Figure 9:
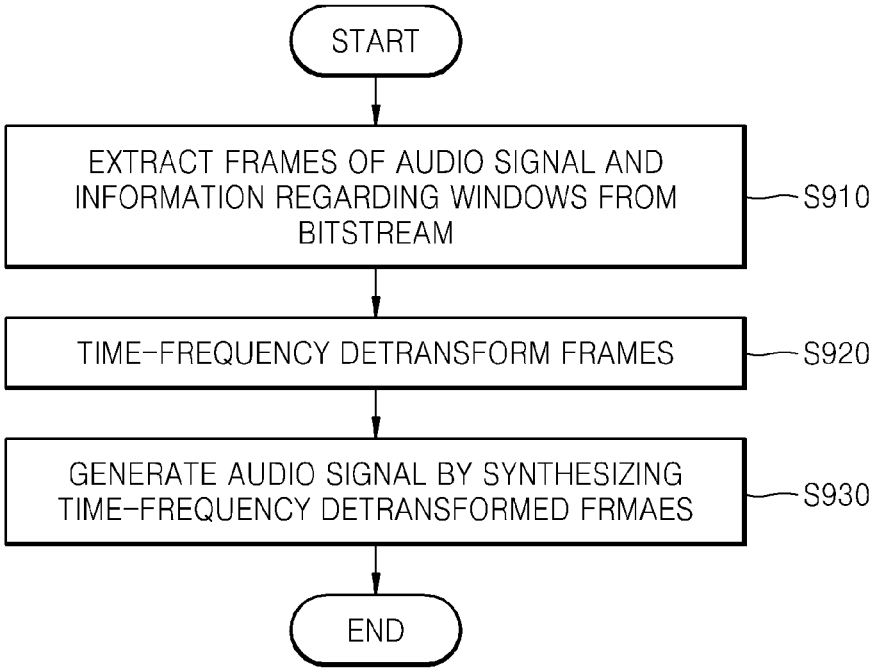
FIG. 9 is a flowchart illustrating a method of decoding an audio signal, according to another embodiment.

FIG. 9 is a flowchart illustrating a method of decoding an audio signal, according to another embodiment.

Referring to FIG. 9, in operation S910, the apparatus 800 extracts frames of a time-frequency transformed audio signal and information regarding windows applied to the frames, from a bitstream. The information regarding the windows may include form and length information of the windows, applied to the frames.

In operation S920, the apparatus 800 time-frequency detransforms the time-frequency transformed frames. The apparatus 800 may perform a detransform, corresponding to the time-frequency transform method performed by the apparatus 300.

In operation S930, the apparatus 800 generates an audio signal by synthesizing the time-frequency detransformed frames, based on the information regarding the windows.

The embodiments can be written as computer programs, and can be implemented in general-use digital computers that execute the programs using a computer-readable recording medium. Examples of the computer-readable recording medium include storage media, such as magnetic storage media (e.g., ROM, floppy disks, hard disks, etc.), optical recording media (e.g., CD-ROMs, or DVDs), and carrier waves (e.g., transmission through the Internet).

While the exemplary embodiments have been particularly shown and described with reference to exemplary embodiments thereof, it will be understood by those of ordinary skill in the art that various changes in form and details may be made therein without changing the technical spirit or the essential features of the exemplary embodiments. Therefore, the embodiments described above should be understood as not limitations, but illustrations of the exemplary embodiments.

What is claimed is:

1. A method of encoding an audio signal, the method comprising:

segmenting the audio signal into a plurality of frames, wherein each of the frames includes M samples and M is a natural number greater than one;

applying a first window, a second window, and at least one third window to the frames, wherein a length of the second window is longer than a length of the first window, and a length of the at least one third window is longer than the length of the first window and shorter than the length of the second window;

time-frequency transforming the frames to which the first window, the second window, and the at least one third window have been applied; and generating a bitstream including the time-frequency transformed frames, wherein each of the second window and the at least one third window includes a first zero duration and a second zero duration in which a coefficient is zero, and a first unity duration and a second unity duration in which a coefficient is one, and a length of the first zero duration, the second zero duration, the first unity duration, and the second unity duration is determined to satisfy a perfect reconstruction condition.

2. The method of claim 1, wherein the applying the first window, the second window, and the at least one third window to the frames comprises applying the first window, the second window, or the at least one third window to one transform unit.

3. The method of claim 1, wherein the first window, the second window, and the at least one third window have a same overlapping duration length where the first window, the second window, and the at least one third window overlap each other, except for durations in which a coefficient is zero.

4. The method of claim 1, wherein the applying the first window, the second window, and the at least one third window to the frames comprises:

applying the first window to a transient duration which includes a transient signal of the audio signal; and applying the at least one third window, which overlaps the first window, which has been applied to the transient duration, to a transform unit including the transient duration.

5. The method of claim 4, wherein a frame size of the at least one third window is set according to a frame size of the first window applied to the transient duration.

6. The method of claim 1, wherein the applying the first window, the second window, and the at least one third window to the frames comprises applying the first window and the at least one third window, or two of the at least one third window, overlapping each other in a variation duration, in which signal characteristics vary in the audio signal, to a transform unit which includes the variation duration.

7. The method of claim 1, wherein the length of the first zero duration, the second zero duration, the first unity duration, and the second unity duration is determined as $(F-L)\div 2$, where F denotes a frame size of a corresponding window, and L denotes an overlapping duration length between windows.

8. The method of claim 1, wherein M is $2^k$, and a length of the first window, the second window, and the at least one third window is $2^k$ samples.

9. The method of claim 1, wherein the bitstream includes information regarding applied windows to the frames of the audio signal.

10. A method of decoding an audio signal, the method comprising:

extracting a plurality of frames of a time-frequency transformed audio signal and information regarding applied windows to the frames, from a bitstream;

time-frequency detransforming the extracted frames; and generating an audio signal by synthesizing the time-frequency detransformed frames based on the information regarding the applied windows, wherein the applied windows to the frames include a first window, a second window, and at least one third window, wherein a length of the second window is longer than a length of the first window, and a length of the at least one third window is longer than the length of the first window and shorter than the length of the second window, wherein each of the second window and the at least one third window includes a first zero duration and a second zero duration in which a coefficient is zero, and a first unity duration and a second unity duration in which a coefficient is one, and a length of the first zero duration, the second zero duration, the first unity duration, and the second unity duration is determined to satisfy a perfect reconstruction condition.

11. The method of claim 10, wherein the generating of the audio signal comprises applying the first window, the second window, or the at least one third window to one transform unit, included in the time-frequency detransformed frames.

12. The method of claim 10, wherein the first window, the second window, and the at least one third window have a same overlapping duration length where the first window, the second window, and the at least one third window overlap each other, except for durations in which a coefficient is zero.

13. The method of claim 10, wherein the length of the first zero duration, the second zero duration, the first unity duration, and the second unity duration is determined as $(F-L)\div 2$, where F denotes a frame size of a corresponding window, and L denotes an overlapping duration length between windows.

14. The method of claim 10, wherein M is $2^k$, and a length of the first window, the second window, and the at least one third window is $2^k$ samples.

15. A non-transitory computer-readable storage medium having stored therein program instructions, which when executed by a computer, performs the method of claim 1.

16. A non-transitory computer-readable storage medium having stored therein program instructions, which when executed by a computer, performs the method of claim 10.

17. An apparatus for encoding an audio signal, the apparatus comprising:

a segmentation unit configured to segment the audio signal into a plurality of frames, wherein each of the frames includes M samples and M is a natural number greater than one;

a window applying unit configured to apply a first window, a second window, and at least one third window to the frames, wherein a length of the second window is longer than a length of the first window, and a length of the at least one third window is longer than the length of the first window and shorter than the length of the second window;

a transformer configured to time-frequency transform the frames to which the first window, the second window, and the at least one third window have been applied; and a multiplexer configured to generate a bitstream, including the time-frequency transformed frames, wherein each of the second window and the at least one third window includes a first zero duration and a second zero duration, in which a coefficient is zero, and a first unity duration and a second unity duration in which a coefficient is one, and the window applying unit is configured to determine a length of the first zero duration, the second zero duration, the first unity duration, and the second unity duration to satisfy a perfect reconstruction condition, wherein at least one of the segmentation unit, the window applying unit, the transformer and the multiplexer is implemented by one or more processors.

18. The apparatus of claim 17, wherein the window applying unit is configured to apply the first window, the second window, or the at least one third window to one transform unit.

19. The apparatus of claim 17, wherein the window applying unit is configured to apply the first window, the second window, and the at least one third window to the frames, such that overlapping durations, in which the first window, the second window, and the at least one third window overlap each other, have a same length, except for durations in which a coefficient is zero.

20. The apparatus of claim 17, further comprising an analyzer for analyzing characteristics of the audio signal, wherein the window applying unit is configured to apply the first window to a transient duration analyzed by the analyzer, and configured to apply the at least one third window, which overlaps the first window, which has been applied to the transient duration, to a transform unit including the transient duration.

21. The apparatus of claim 20, wherein the window applying unit is configured to set a frame size of the at least one third window according to a frame size of the first window applied to the transient duration.

22. The apparatus of claim 17, wherein the window applying unit is configured to apply the first window and the at least one third window, or two of the at least one third window, overlapping each other in a variation duration, in which characteristics of the audio signal analyzed by an analyzer vary, to a transform unit which include the variation duration.

23. The apparatus of claim 17, wherein the window applying unit is configured to determine the length of the first zero duration, the second zero duration, the first unity duration, and the second unity duration as $(F-L)\div 2$, where F denotes a frame size of a corresponding window, and L denotes an overlapping duration lengths between windows.

24. The apparatus of claim 17, wherein M is $2^k$, and a length of the first window, the second window, and the at least one third window is $2^k$ samples.

25. The apparatus of claim 17, wherein the bitstream includes information regarding applied windows to the frames of the audio signal.

26. An apparatus for decoding an audio signal, the apparatus comprising:

a demultiplexer configured to extract a plurality of frames of a time-frequency transformed audio signal and information regarding applied windows to the frames, from a bitstream;

a detransformer configured to time-frequency detransform the extracted frames; and a synthesizer configured to generate an audio signal by synthesizing the time-frequency detransformed frames based on the information regarding the applied windows, wherein the applied windows to the frames include a first window, a second window, and at least one third window, wherein a length of the second window is longer than a length of the first window, and a length of the at least one third window is longer than the length of the first window and shorter than the length of the second window, wherein each of the second window and the at least one third window includes a first zero duration and a second zero duration in which a coefficient is zero, and a first unity duration and a second unity duration in which a coefficient is one, and a length of the first zero duration, the second zero duration, the first unity duration, and the second unity duration is determined to satisfy a perfect reconstruction condition, wherein at least one of the demultiplexer, the detransformer and the synthesizer is implemented by one or more processors.

27. The apparatus of claim 26, wherein the synthesizer is configured to apply the first window, the second window, or the at least one third window to one transform unit, included in the time-frequency detransformed frames.

28. The apparatus of claim 26, wherein the first window, the second window, and the at least one third window have a same overlapping duration length where the first window, the second window, and the at least one third window overlap each other, except for durations in which a coefficient is zero.

29. The apparatus of claim 26, wherein the length of the first zero duration, the second zero duration, the first unity duration, and the second unity duration is determined as $(F-L)\div 2$, where F denotes a frame size of a corresponding window, and L denotes an overlapping duration length between windows.

30. The apparatus of claim 26, wherein M is $2^k$, and a length of the first window, the second window, and the at least one third window is $2^k$ samples.

* * * * *